United States Patent [19]

Brown

[11] Patent Number: 5,068,577

[45] Date of Patent: Nov. 26, 1991

[54] CONSTANT CURRENT DRIVE SYSTEM FOR FLUORESCENT TUBES

[75] Inventor: Brent W. Brown, Logan, Utah

[73] Assignee: Integrated Systems Engineering, Inc., Logan, Utah

[21] Appl. No.: 615,690

[22] Filed: Nov. 19, 1990

[51] Int. Cl.[5] ..... H05B 41/36; H05B 41/44

[52] U.S. Cl. ..... 315/307; 315/171; 315/175; 315/315; 315/316

[58] Field of Search ..... 315/158, 160, 161, 164, 315/170, 171, 175, 176, 205, 307, 310, 311, 315, 317, 320, 324

[56] References Cited

U.S. PATENT DOCUMENTS

| | | | |
|---|---|---|---|
| 2,927,247 | 3/1960 | Hennis | 315/135 |
| 2,989,663 | 6/1961 | Rowe | 315/207 |
| 3,119,048 | 1/1964 | Tsuchiya | 315/200 R |
| 3,234,847 | 2/1966 | Williams | 88/24 |
| 3,271,620 | 9/1966 | Webb | 315/160 |
| 3,280,369 | 10/1966 | Baum et al. | 315/243 |
| 3,310,708 | 3/1967 | Seidler | 315/225 |
| 3,367,313 | 2/1968 | Bom et al. | 123/148 |
| 3,434,463 | 3/1969 | Bartch | 123/624 |
| 3,444,431 | 5/1969 | Goldberg | 315/200 |
| 3,478,248 | 11/1969 | Ivec | 315/205 |
| 3,553,528 | 1/1971 | Somlyody | 315/209 |
| 3,611,024 | 10/1971 | Nakatsu et al. | 315/205 |
| 3,720,861 | 3/1973 | Kahanic | 315/310 X |
| 3,745,411 | 7/1973 | Polman et al. | 315/209 R |
| 3,789,211 | 1/1974 | Kramer | 240/10 R |
| 3,805,049 | 4/1974 | Frank et al. | 240/10 R |
| 3,882,356 | 5/1975 | Stehlin | 315/205 |
| 3,921,035 | 11/1975 | Holmes | 315/307 |
| 4,009,416 | 2/1977 | Lowther | 315/176 |
| 4,107,580 | 8/1978 | Thackray | 315/311 |
| 4,158,793 | 6/1979 | Lewis | 315/101 |
| 4,173,730 | 11/1979 | Young et al. | 315/53 |
| 4,234,823 | 11/1980 | Charlot | 315/224 |
| 4,238,709 | 12/1980 | Wallace | 315/291 |
| 4,327,309 | 4/1982 | Wallot | 315/170 |
| 4,358,717 | 11/1982 | Elliot | 315/311 X |
| 4,362,971 | 12/1982 | Sloan, Jr. | 315/176 |
| 4,417,180 | 11/1983 | Chamran et al. | 315/171 X |
| 4,417,182 | 11/1983 | Weber | 315/210 |
| 4,475,067 | 10/1984 | Rowe | 315/360 |
| 4,550,272 | 10/1985 | Kimura et al. | 315/205 X |
| 4,559,478 | 12/1985 | Fuller | 315/224 |
| 4,595,863 | 6/1986 | Henning | 315/208 |
| 4,617,496 | 10/1986 | Samodovitz | 315/208 |
| 4,625,152 | 11/1986 | Nakai | 315/317 |
| 4,629,946 | 12/1986 | Amano et al. | 315/158 X |
| 4,739,225 | 4/1988 | Roberts et al. | 315/208 |
| 4,742,276 | 5/1988 | Ku | 315/175 X |
| 4,887,004 | 12/1989 | Kraaij et al. | 315/86 |
| 4,894,645 | 1/1990 | Odlen | 315/316 X |
| 4,899,086 | 2/1990 | Hirata et al. | 315/169.3 |
| 4,902,939 | 2/1990 | Harvey | 315/316 |
| 4,904,903 | 2/1990 | Pacholok | 315/307 X |

FOREIGN PATENT DOCUMENTS 369824 3/1932 United Kingdom .

*Primary Examiner*—David Mis

*Attorney, Agent, or Firm*—Lynn G. Foster

[57] ABSTRACT

Novel systems, circuits, and methods for initiating ionization, maintaining constant illumination current, and extinguishing illumination in a gas discharge tube and in gas discharge tube arrays. Input controls for current regulating circuits for gas discharge tubes comprise directly connected semiconductor logic circuits. In the currently preferred embodiment, each gas discharge tube is maintained in consistently bright illumination by a constant current or extinguished by inhibition of the constant current, as controlled by a surprisingly simple circuit comprising a single PNP transistor and three resistors. A parallel coupled input which provides an impedance connection for a gas discharge tube ionizing high voltage pulse comprises a single resistor and a serially interposed isolating diode which protects the transistor from the high voltage ionizing pulse and imposes the ionizing pulse primarily upon the gas discharge tube. The constant illumination maintaining current provides a controlled illumination brilliance from each emitting gas discharge tube which is particularly useful in large display arrays such as programmable signs, scoreboards and the like.

31 Claims, 1 Drawing Sheet

CONSTANT CURRENT DRIVE SYSTEM FOR FLUORESCENT TUBES

FIELD OF INVENTION

This invention relates to systems, circuits, and methods for initiating, maintaining, and controlling illumination in gas discharge devices. It is also concerned with logical control and brightness regulation of individual flurorescent lamps used in large display arrays.

RELATED ART

The use of ballasts in circuits for sustaining electrical discharge in fluorscent tubes and other arc discharge devices is generally known. An essential characteristic of arc discharge devices is a high illumination starting voltage to initiate ionization. After ionization has been achieved, it is necessary to reduce the drive voltage to the tube to inhibit excessive current flow due to the rapidly falling resistance of a freshly illuminated tube. Normally, the lower maintenance drive voltages provided after the initially high starting voltage restrict large increases in current which may result in unstable operation and damage to the tube. Generally, ballasts comprise a series impedance when the power source is D.C. or a substantial reactance when the power source is A.C.

The combined problems of starting and maintaining illumination in gas discharge tubes have been addressed in many ways. Problems related to gas discharge tube ionization, intermittent or flashing light control, high frequency drive, achieving higher tube illumination, direct current or battery driven gas discharge systems, solid state ballast circuits, and the like, to some extent, are addressed in British Pat. 369,824 and the following U.S. Patents:

| U.S. Pat. No. | U.S. Pat. No. |
|---|---|
| 2,927,247 | 4,158,793 |
| 3,271,620 | 4,173,730 |
| 3,280,369 | 4,327,309 |
| 3,444,431 | 4,234,823 |
| 3,611,024 | 4,362,971 |
| 3,745,411 | 4,559,478 |
| 3,882,356 | 4,595,863 |
| 4,009,416 | 4,887,004 |
| 4,107,580 | 4,902,939 |

Known semiconductor gated or logical control of gas tube illumination has generally involved control and termination of gas discharge illumination by controlling the voltage potential across the tube. For example, U.S. Pat. No. 2,927,247 provides an open circuit or a logical ground at a central node of a voltage dividing resistor circuit in series with a gas discharge tube to vary the potential across the tube, whereby the voltage across the tube is varied to a potential which exceeds the maximal firing voltage or dropped below the minimum extinguishing voltage.

Solid state adaptive ballast systems are also known in the art. Transistors have been used in series with gas discharge tubes to provide ballast feedback and control circuits which limit the voltage drop across a ballast as disclosed in U.S. Pat. No. 4,107,580. Also, circuits have been designed for coupling logic drivers to power devices in a solid state fluorescent lamp ballast system in which isolation between the high voltage power devices and the logic drivers is obtained by using voltage level shift transistors as described in U.S. Pat. No. 3,882,356.

A circuit which serially imposes a transistor between an electrode of the gas discharge tube and one of the supply voltages to control current through the tube to, in one operating state, maintain current controlled illumination and, in another operating state, terminate current through the tube is disclosed in U.S. Pat. No. 4,595,863. Current control is accomplished by a variable base resistor connected therefrom to a reference voltage. While this circuit provides for essentially constant current illumination control and logically controllable illumination extinguishing, interconnection to gating logic circuits necessarily requires use of an opto-controller which buffers the illumination maintaining voltage from high voltage sensitive logic circuits or other relatively expensive means.

BACKGROUND

Current variations in gas discharge tubes are a function of tube temperature, condition of the tube cathode, and the regulation of the power supply. Such current variations cause visually discernable variation in the illumination and affect useful tube longevity. Such tubes have not often been used in large colored sign displays, such as programmable scoreboards, to some extent at least because such use would require a relatively constant output, such that a programmed display of a single color appears uniform.

BRIEF SUMMARY AND OBJECTS OF THE INVENTION

It is well known that transistor logic levels and supply voltages are significantly lower than the voltage levels required to maintain luminescence in a fluorescent tube. It is also well known that the voltage drop across a conducting tube varies as a function of temperature, tube aging, and normal variations even between tubes of the same design. Also, the minimum voltage required to ionize and maintain luminescence in each fluorescent tube similarly varies from tube to tube. Such variations also produce variable tube illumination under different operating conditions within the same tube. For these reasons, achieving and maintaining a standard level of brightness, a critical and necessary parameter for lamps and tubes used in large display arrays for signs, scoreboards and the like, cannot be achieved by controlling only the voltage across a gas discharge tube.

Using a surprisingly simple circuit and two interconnected power supplies, the present invention alleviates known problems related to providing a logically controllable circuit and system for maintaining a consistently illuminated gas discharge tube. The invention comprises current regulating and luminescence control circuits which connect directly to logic circuits, requiring no special buffering or interface. At one binary output level, the logic circuits gate the current regulating and luminescence control circuits to extinguish tube illumination. At the other binary output level, the logic circuits gate the current regulating and luminescence control circuits to controllably provide an illumination maintaining voltage across the tube and simultaneously provide a controlled constant current flow therethrough.

The current regulating and gating circuits comprise serial connections between a first electrode of a gas discharge tube or lamp and a terminal comprising an interconnection of the high voltages of a well regulated logic power supply a loosely regulated power supply. The current regulating and gating circuits further comprise a serially connected semiconductor current gate, a current determining impedance, which is connected between the current gate and the commonly interconnected high voltages, and a voltage divider. When acted upon by signals at a first voltage level from the gating logic circuits, the voltage divider provides a gating voltage level to the semiconductor current gate which, in turn, provides a conductive path for current through the gas discharge tube. When acted upon by signals at a second voltage level, the voltage divider provides a voltage level to the semiconductor gate which, thereby, inhibits conduction and extinguishes conduction and luminescence in the tube.

As earlier described, the high voltage output of each of the two power supplies, comprising a loosely regulated floating supply and a well regulated logic supply, are interconnected. The loosely regulated supply comprises a voltage differential between its low and high voltage outputs which provides an illumination-maintaining voltage for the gas discharge tube or lamp. For tubes comprising AC filaments, a low voltage filament supply is provided by the loosely regulated supply and connected to a second electrode or filament end of the gas discharge tube. The DC reference of the filament supply is essentially the potential of the low voltage output of the loosely regulated supply. The well regulated logic supply comprises a ground and logic supply voltage and provides a voltage differential which is compatible with standard semiconductor logic supplies.

A high voltage isolator, such as a diode, is interposed in series between the first electrode and semiconductor current gate. A parallel connection to the first electrode is provided for an intermittently imposed high voltage pulse which provides ionizing illumination voltage when exciting and ionizing the gas discharge tube and an open circuit otherwise. The diode impedance provides protection from high voltage damage to the current regulating and gating circuits by the high voltage pulse and effectively blocks current leakage through the current regulating and gating circuits, thereby, effectively clamping the ionizing high voltage pulse across the gas discharge tube.

In combination, the current limiting impedance and the semiconductor current gate, when opened by a signal of the first voltage level from the voltage divider, draw a fixed, predetermined current through the gas discharge tube, thus providing constant and controlled illumination. Conversely, when closed by a signal of the other binary level from the logic gating circuits, the semiconductor current gate extinguishes illumination by terminating current flow through the tube.

A plurality of gas discharge tubes and associated control circuits are typically combined in a system, providing a programmable array of gas discharge tubes for a sign, scoreboard, or the like, which are individually and directly controlled by circuits operating at standard logic levels.

With the foregoing in mind, it is a dominant object of the present invention to overcome or substantially alleviate problems of the prior art.

It is another primary object to provide a directly logically controlled semiconductor gating circuit which, while ON, maintains constant illumination by maintaining constant current flow through a series connection to a first element of a gas discharge tube and, when OFF, terminates current flow, thereby extinguishing illumination in the gas discharge tube.

It is a further primary object to provide a system which variably controls an array of gas discharge tubes by a plurality of semiconductor gating circuits, each of which, while ON, maintains constant illuminating current in each associated gas discharge tube and, when OFF, extinguishes illumination in each associated gas discharge tube, under directly connected logic control from standard logic circuits in a control portion of the system.

It is a fundamental object to provide gating inputs to semiconductor gating circuits which operate at standard logic voltage levels.

It is a further fundamental object to provide at least two power supplies, one of which is loosely regulated and one of which is well regulated, interconnected such that their high voltages are referenced at the same terminal and, when connected to a first element of a gas discharge tube, provide adequate voltage to maintain illumination.

It is an important object to provide a connection from the loosely regulated supply to a second element of the gas discharge tube, thereby providing a current source and a referenced voltage which is of opposite polarity to high voltage of the well regulated supply.

It is a still further fundamental object that the well regulated supply provide standard logic voltage levels and essentially power semiconductor gating circuits operation.

It is an important object to provide a connection for an intermittent, gas discharge tube illuminating high voltage pulse source, such that deionized tubes are selectively illuminated.

It is a further significant object ot provide a connection to the intermittent, gas discharge tube illuminating high voltage pulse source which is connected when a high voltage pulse is present and open when the high voltage pulse is not present.

It is a further consequential object to provide an isolator between the intermittent high voltage pulse source connection and semiconductor gating circuits, such that the circuits are not damaged by the intermittent high voltage pulse.

It is a still further consequential object to provide an isolator between the intermittent high voltage pulse source connection and semiconductor gating circuits to block current flow from the intermittent high voltage pulse source, thereby effectively applying the entire high voltage pulse current across the gas discharge tube.

These and other objects and features of the present invention will be apparent from the detailed description taken with reference to accompanying drawings.

DETAILED DESCRIPTION OF THE ILLUSTRATED EMBODIMENTS

In this description, the term logic refers to digital semiconductor circuits generally used in computers and digital control devices. Voltage power supply levels for such circuits comprise logic ground and logic supply, which is typically 12 to 15 volts away from ground. The polarity of the logic supply is customarily dependent upon the use of NPN or PNP transistor gates. Herein, the terms lamps and tubes are used interchangably and signify gas discharge tubes.

Figure 1:
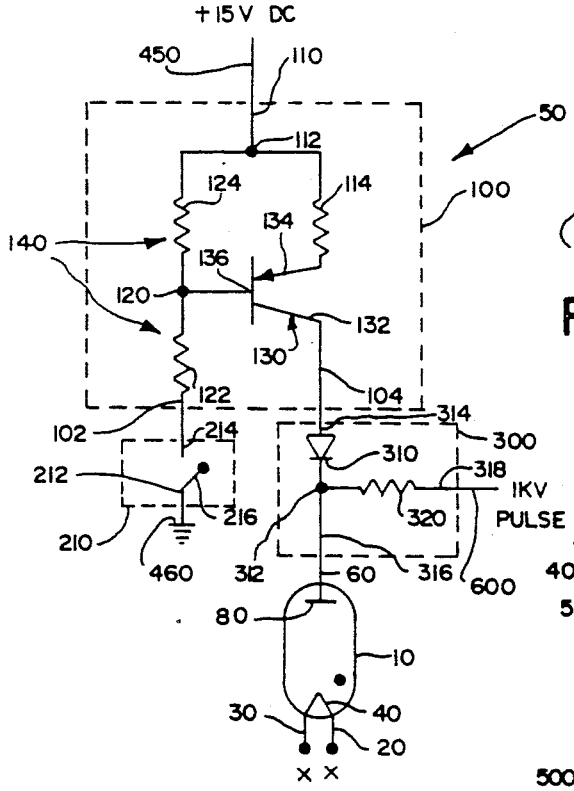
FIG. 1 is a schematic of a logically controlled circuit for illumination maintenance, termination control, and ionization of a gas discharge tube or lamp.
Figure 2:
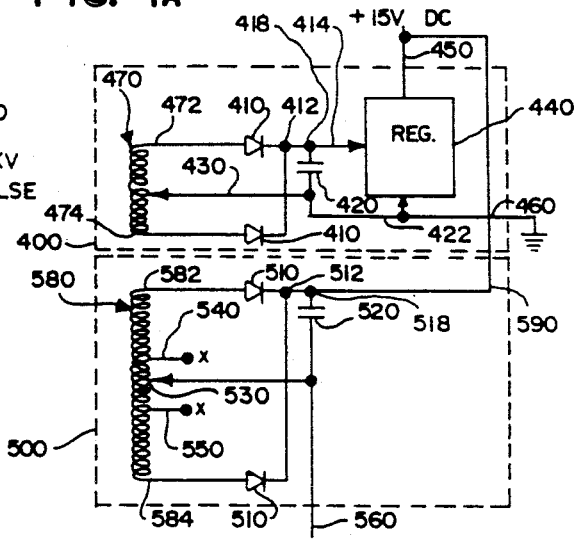
FIG. 2 is a schematic of two interconnected power supplies, one of which is well regulated and one of which is loosely regulated.
Figure 3:
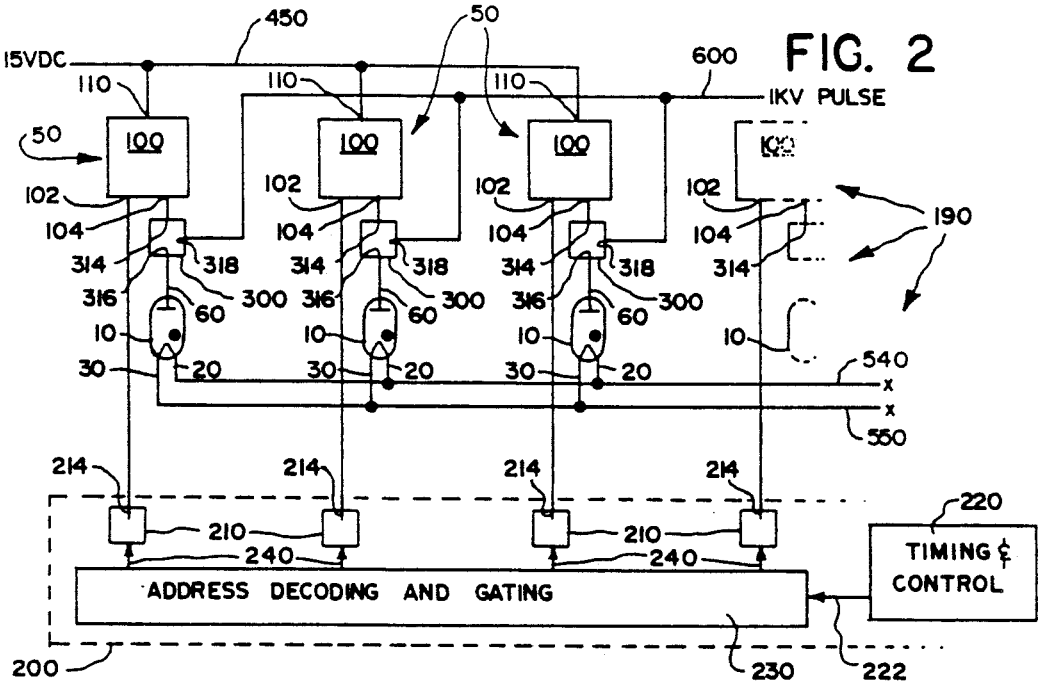
FIG. 3 is a fragmentary block diagram of an gas discharge tube array and control system.

Reference is now made to the embodiments illustrated in FIGS. 1–3 wherein like numerals are used to designate like parts throughout. As seen in FIG. 1, the currently preferred embodiment comprises an illumination control circuit 50 for a gas discharge tube 10. Control circuit 50 comprises a transistor gating circuit 100, a control logic input circuit 210, and a high voltage pulse circuit 300 for connecting an intermittent high voltage pulse across gas discharge tube 10 by which gas discharge tube 10 is ionized and illumination initiated.

Gating circuit 100 comprises a PNP transitor 130, a voltage divider 140 comprising resistor 124 serially connected to resistor 122, and a current determining resistor 114. As seen in FIG. 1, the common node 120 of voltage divider 140 also comprises a connection to base 136 of transistor 130. On the end opposite node 120, resistor 124 connects to a 15 V DC logic supply through a connecting node 112. On the other end of voltage divider 140, resistor 122 connects via conductor 102 to control logic input circuit 210 which provides a logic ground 460 to signal illumination maintenance and either a logic supply voltage or an open circuit to signal illumination termination. The 15 V DC logic supply is provided by a well regulated voltage supply 400, which is described in detail later.

Transistor 130 emitter 134 is connected through precision resistor 114 to node 112 and therefrom through conductor 110 to 15 V DC logic supply. Transistor 130 collector 132 comprises an output which is serially connected through the high voltage pulse circuit 300 to gas discharge tube 10.

Central logic input circuit 210 is seen to contain a switch 216 in FIG. 1. As seen therein, based upon the state of the switch 216, either a logic ground 460 is connected to voltage divider 140 through logic output conductor 214 and receiving logic input conductor 102 or an open circuit is provided through the same conductor pathway. However, switch 216 is exemplary and is known by those skilled in the art to be replaceable by standard semiconductor logic drivers.

High voltage pulse circuit 300 comprises a diode 310 oriented to isolate transistor gating circuit 100 from the high voltage pulse, which may exceed 1000 volts, required to ionize gas discharge tube 10. So oriented, on one end diode 310 is serially connected through series conductor 314 to series conductor 104 to collector 132. On the other end, diode 310 is serially connected to anode 80 through conductor 316 and tube connection 60 to anode 80 of gas discharge tube 10. Conductor 316 comprises a connecting node 312 whereat a load resistor 320 connects at one end. On the other end 318 load resistor 320 connects to a 1 KV pulse input conductor 600 whereat the gas discharge tube 10 ionizing and illuminating 1 KV pulse generating circuit (not shown) connects. Circuits and components for generating 1 KV pulses which provide controllably initiated intermittent 1 KV pulses through the pulse period and a substantially open circuit otherwise are known and available in the art.

A combination of two power supplies for providing power and controlling illumination to a gas discharge tube 10 is seen in FIG. 2. The combination comprises a well regulated voltage supply 400 connected to a loosely regulated voltage supply 500. Power for each well and loosely regulated supply 400 and 500, respectively, is provided through secondary transformer windings 470 and 580, respectively. The primary transformer windings are not shown.

Well regulated voltage supply 400 comprises the secondary windings 470, two diode rectifiers 410, a shunt capacitor 420, a regulator 440, and external connections further comprising logic supply voltage 450 and logic ground 460. Secondary windings 470 comprise taps 472 and 474 which provide a 15 V DC logic supply voltage 450 from regulator 440. Each diode rectifier 410 is serially interposed between a tap 472 or 474 and a common connecting node 412. Connection is made from node 412 to regulator 440 through conductor 414. Center tap 430 provides a reference for logic ground 460 and connects through conductor 422 to regulator 440. A shunt capacitor 420, comprising a loosely regulating filter for the full-wave rectified signal emanating from node 412, also connects between conductor 414 through node 418 and center tap 430. Regulator 440 is a standard adjustable voltage regulator, which is readily available in the art, providing well regulated, selectable voltages in the range of 12 to 15 volts.

Loosely regulated voltage supply 500 comprises the secondary windings 580, two diode rectifiers 510, a shunt capacitor 520, and external connections further comprising high voltage output 590 and low voltage out (low reference voltage) 560. Secondary windings comprise taps 582 and 584 which provide a loosely regulated voltage between high voltage output 590 and low voltage out 560. Each diode rectifier 510 is serially interposed between a tap 582 or 584 and a common connecting node 512. Connection is made from node 512 to high voltage output 590 wherefrom serial connection is made to logic supply voltage 450. High voltage output 590 also provides a reference for the high voltage pulse generating circuits. Center tap 530 provides a reference voltage near that of cathode filament 40. Two additional taps 540 and 550 providing the AC supply voltage are connected to filament conductors 20 and 30 and across filament 40. (See FIG. 1.) A shunt capacitor 520, comprising a loosely regulating filter for the full-wave rectified signal emanating from node 512, also connects between high voltage output 590 through node 518 and center tap 530. The voltage drop across high voltage output 590 and low voltage output 560 comprises a voltage difference which, depending upon individual gas discharge tube design, ranges between 40 V to 70 V DC and provides an adequate potential to maintain illumination in a previously ionized lamp.

So powered and interconnected, control circuit 50 maintains illumination in a previously ionized gas discharge tube 10 when switch 216 is closed (or logic output conductor 214 is logically controlled to be near logic ground) to produce a divided voltage at base 136 which causes transistor 130 to conduct. Emitter 134 to base 136 conduction imposes essentially the divided voltage at 120 upon emitter 134. The divided voltage at base 136 is precisely controlled by the voltage differential between the logic supply and logic ground voltages. For this reason, the current through resistor 114 is also precisely predetermined. Conducting transistor 130 comprises the only path for current through gas discharge tube 10 after initial ionization and illumination by the 1 KV pulse terminates. Thus, the high voltage output 590 maintains gas discharge tube 10 illumination and the constant current as primarily defined by the value of resistor 114 maintains a constant illumination.

As the value of resistor 114 substantially determines the current through gas discharge tube 10, changing the value of resistor 114 or the value of well regulated voltage logic supply 400 changes the current flowing through gas discharge tube 10 and thereby changes the illumination brilliance thereof. Thus, adjusting regulator 400 to change the logic supply voltage from 12 and 15 volts provides a change in current through the tube of approximately twenty-percent, providing an efficient and effective means of adjusting the illumination brilliance of gas discharge tube 10.

When switch is open (or logic output conductor 214 is logically controlled to be near the logic supply voltage), transistor 130 conduction is terminated, thus terminating current through gas discharge tube 10 and extinguishing ionization and illumination. Transistor 130 is a power transistor, such as a TIP15, which is able to withstand the high voltage output 590 of the loosely regulated voltage supply 500 when imposed across control circuit 50. Diode 310 must withstand the voltage difference between the high voltage pulse and the high voltage output 590 of the loosely regulated voltage supply 500, which is on the order of 1000 V, wherefore a diode such as a 1N4007 may be used.

Figure 1A:
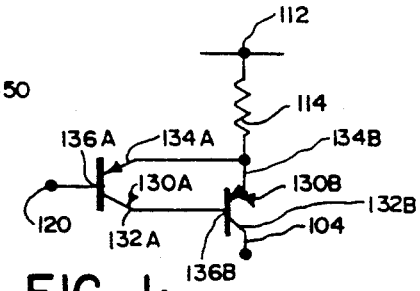
FIG. 1*a* is a schematic of a composite or Darlington transistor pair.

In another embodiment, a composite or Darlington pair 138 of transistors, as seen in FIG. 1*a*, comprise an effective substitute for transistor 130. The composite pair 138 comprise two transistors, 130A and 130B, connected as shown in FIG. 2 with emitters 134A and 134B commonly connected to resistor 114. Collector 132A connects directly to base 136B. Operation of the composite pair 138 is similar to that of single transistor 130, wherein the voltage imposed upon base 136A is seen by emitter 134A, base 136B, and emitter 134B and is therefore seen by current determining resistor 114. The serial current path formed by collector 132B gates current in the same manner collector 132 gated the current in transistor 130.

Seen in block diagram format in FIG. 3 is an array 190 comprising gas discharge tubes 10, associated control circuits 50, high voltage pulse circuits 300, and a control system 200. Common filament voltages are provided from taps 540 and 550. The 1 KV pulse is used to excite a plurality of gas discharge tubes 10 at one time through high voltage pulse circuits 300, although, a separate and independently provided 1 KV pulse may be used to selectively excite gas discharge tubes 10 in one part of array 190 at a time different from excitement of gas discharge tubes 10 in another part of array 190 by other 1 KV pulses. Control system 200 is seen in FIG. 3 to comprise timing and control block 220, a plurality of logic input circuits 210, and an address decoding and gating block 230, although such address decoding and gating and timing and control circuits could be provided many forms, including, but not limited to, central processing units. Each control logic circuit 210 comprises an individually selectable control line 240 which transmits associated control signals from address decoding and gating block 230 and by which lamps are individually extinguished providing an infinite number of pattern sequences displayable by array 190. Timing and control block 220 programmably sequences pattern selection and communicates with address decoding and gating block circuits through cable 222.

In use, a ground signal is sent, via conductors 102, to a plurality of gas discharge tubes 10 to be ionized or illuminated.

In use, a ground signal is sent, via conductors 102, to a plurality of gas discharge tubes 10 to be ionized or illuminated. The so selected gas discharge tubes 10 are then ionized, as a group, by a 1 KV pulse received by each associated high voltage pulse circuit 300. At times, predetermined by timing and control block 220, a signal is selectively transmitted to each related logic input circuit 210 removing the ground signal from associated conductor 102, thereby inhibiting conduction in transistor 130 and extinguishing each gas discharge tube 10 individually.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A system for selectively igniting and maintaining constant conduction and illumination and extinguishing illumination in a gas discharge tube having at least two electrodes and ignition and illumination maintaining voltage levels which are greater than a maximum safe logic voltage level, said system comprising:

first means for selectively communicating the gas discharge tube igniting voltage to a first electrode of the gas discharge tube;

a substantially constant DC illumination maintaining voltage power supply comprising means for providing an illumination maintaining voltage reference level and means for providing a low voltage reference level;

a well regulated logic voltage level power supply, the electrical current flow through which is substantially independent of changes in electrical current flowing through the gas discharge tube;

second means, comprising an on/off semiconductor gate in series with the gas discharge tube, for communicating a substantially constant current to the first electrode of the gas discharge tube during the period of illumination;

third means for communicating the low voltage reference level to a second electrode of the gas discharge tube whereby the voltage drop across the tube is sufficient to maintain tube illumination;

fourth means, comprising logic voltage level gating circuits electrically connected to the on/off semiconductor gate, for selectively terminating conduction in the on/off semiconductor gate thereby extinguishing illumination in the gas discharge tube.

2. A system according to claim 1 wherein the first means comprise load resistor means.

3. A system according to claim 1 further comprising a one-way current communicating means interposed between the first and second means.

4. A system according to claim 3 wherein the one-way current communicating means comprise diode means.

5. A system according to claim 1 wherein the second means comprise current-determining resistor means serially-connected to the on/off semiconductor gate.

6. A system according to claim 5 wherein the current-determining resistor means are located more remote from the first electrode of the gas discharge tube than the on/off semiconductor gate are remote from the first electrode of the gas discharge tube.

7. A system according to claim 1 wherein the logic voltage level gating circuits comprise semiconductor components for electrically changing the state of the on/off semiconductor gate.

8. A system according to claim 1 wherein said logic voltage level gating circuits comprise voltage divider means and selective on/off timing means.

9. A system according to claim 7 wherein said semiconductor components are subjected to logic voltage levels which comprise voltage levels lower than the ignition and illumination voltage levels of the gas discharge tube.

10. A system according to claim 1 wherein the on/off semiconductor gate comprises a single transistor.

11. A system according to claim 5 wherein said current-determining resistor means comprises a fixed value resistor.

12. A system according to claim 1 wherein the third means comprise transformer voltage supply means.

13. A method of selectively starting, maintaining constant conduction and illumination, and extinguishing illumination in a gas discharge tube having at least two electrodes and ignition and illumination maintaining voltage levels which are greater than a maximum safe logic voltage level, comprising the steps of:

providing the gas discharge tube;

providing a DC illumination maintaining voltage power supply comprising means for providing a substantially constant illumination maintaining voltage reference level and means for providing a low voltage reference level;

providing a well regulated logic voltage level power supply, and connecting the well regulated logic voltage level power supply to the constant DC illumination maintaining voltage power supply such that the current supply through the well regulated logic voltage level power supply is substantially independent of changes in electrical current flowing through the gas discharge tube;

connecting a selectively starting, maintaining and extinguishing circuit comprising a semiconductor gate, connected in series with a current determining resistor and disposed between the DC illumination maintaining voltage power supply and the gas discharge tube, to the gas discharge tube such that illumination maintaining current of the gas discharge tube flows exclusively through the semiconductor gate;

communicating a high voltage starting pulse to one electrode of the tube to ionize the tube;

communicating substantially constant illumination maintaining current from the DC illumination maintaining voltage power supply to each electrode of the ionized tube;

selectively terminating conduction in the semiconductor gate to extinguish illumination of the gas discharge tube.

14. A method according to claim 13 wherein the second communicating step comprises communicating current serially across a current-determining resistor when the semiconductor gate is in its current conducting state.

15. A method according to claim 14 wherein the first communicating step comprises electrically isolating the current determining resistor and the semiconductor gate from the high voltage starting pulse.

16. A method according to claim 13 wherein the first communicating step comprises communicating the high voltage starting pulse across a load resistor.

17. A method according to claim 13 wherein the selectively terminating conduction step further comprises a step of communicating a gating binary signal to the semiconductor gate by switching the gating binary signal from a conductive gating voltage potential to a non-conductive gating voltage potential.

18. A method according to claim 17 wherein the further step of communicating a gating binary signal to the semiconductor gate also comprises changing the conducting status of the gas discharge tube.

19. A system for extinguishing a previously ignited constantly conducting and illuminated fluorescent tube having at least two opposed electrodes and ignition and illumination maintaining voltage levels which are greater than a maximum safe logic voltage level, said system comprising:

a fluorescent tube;

means imposing a voltage drop across the fluorescent tube sufficient to maintain tube illumination once illumination is established, said imposing means comprising a DC illumination maintaining voltage power supply comprising means for providing a substantially constant illumination maintaining voltage reference level and means for providing a low voltage reference level and current controlling means by which substantially constant current is caused to flow to one electrode of the tube whereby the tube illumination is caused to be of a substantially constant brightness;

the current controlling means further comprising a well regulated logic voltage level power supply connected to the constant DC illumination maintaining voltage power supply such that current supplied through the well regulated logic voltage level power supply is substantially independent of a change in electrical current flowing through the gas discharge tube and semiconductor gating means which, when conducting, maintain conduction through the gas discharge tube thereby providing a constant illumination maintaining current and, when non-conducting, terminate conduction through the gas discharge tube thereby extinguishing illumination in the gas discharge tube, the semiconductor gating means being binarily controlled by logic level signals referenced to the voltage of the logic voltage level power supply.

20. A system according to claim 19 wherein the current controlling means comprise current-determining resistor means.

21. A system according to claim 19 wherein the current controlling means comprise constant value current-determining resistor means.

22. A system according to claim 19 wherein the current controlling means comprise constant value current-determining resistor means in series with the semiconductor gating means.

23. A method of extinguishing a previously ignited constantly conducting and illuminated fluorescent tube having at least two opposed electrodes and ignition and illumination maintaining voltage levels which are greater than a maximum safe logic voltage level, comprising the steps of:

providing a DC illumination maintaining voltage power supply comprising means for providing a substantially constant illumination maintaining voltage reference level and means for providing a low voltage reference level;

imposing the output voltage of the DC illumination maintaining voltage power supply across the tube to maintain tube illumination, once illumination has been established;

providing a well regulated logic voltage level power supply and connecting the well regulated logic voltage level power supply to the constant DC illumination maintaining voltage power supply such that the current supply through the well regulated logic voltage level power supply is substantially independent of changes in electrical current flowing through the gas discharge tube;

switching a semiconductor gate interposed between the DC illumination maintaining voltage power supply and the fluorescent tube to a conductive state thereby causing current supplied by the DC illumination maintaining voltage power supply to flow at a substantially constant rate from the source through current-determining structure to one electrode of the illuminated tube whereby the tube illumination is caused to be of a substantially constant brightness; and switching the semiconductor gate to a non-conductive state to extinguish illumination in the gas discharge tube, the semiconductor gating means being binarily controlled by logic level signals the electrical power for which is derived from the well regulated logic voltage level power supply.

24. A system for starting and maintaining constant conduction and illumination and extinguishing illumination in a gas discharge tube having at least two opposed electrodes and ignition and illumination maintaining voltage levels which are greater than a maximum safe logic voltage level, said system comprising:

first circuit means by which a high voltage starting pulse is selectively communicated to a first electrode of the tube to ionize the tube;

a DC illumination maintaining voltage power supply comprising means for providing a substantially constant illumination maintaining voltage reference level and means for providing a low voltage reference level;

a well regulated logic voltage level power supply, the current supply through which is substantially independent of changes in electrical current flowing through the gas discharge tube;

second circuit means comprising means receiving power from the well regulated logic voltage level power supply and on/off semiconductor gating means by which constantly conducting and illuminating current is selectively communicated to the first electrode of the tube;

one-way means interposed between the first and second circuit means whereby the second circuit means are isolated from the high voltage starting pulse and current flow to the first electrode is accommodated; and third circuit means, comprising logic voltage level gating circuits, receiving power from the well regulated logic voltage level power supply, and electrically connected to the second circuit means, for selectively terminating conduction in the on/off semiconductor gating means thereby extinguishing illumination in the gas discharge tube.

25. A system according to claim 24 wherein the one-way means comprises diode means.

26. A system for selectively controlling illumination in each fluorescent tube in a display array of fluorescent tubes, each fluorescent tube having at least two electrodes, ignition and illumination maintaining voltage levels which are greater than a maximum safe logic voltage level, and ignition voltage levels which are substantially greater than illumination maintaining voltage levels, said system comprising:

first means for communicating the gas discharge igniting voltage to a first electrode of each fluorescent tube;

a DC illumination maintaining voltage power supply comprising means for providing a substantially constant illumination maintaining voltage reference level and means for providing a low voltage reference level;

a well regulated logic voltage level power supply connected to the DC illumination maintaining voltage power supply such that the current supply of the well regulated power supply is substantially independent of changes in electrical current flowing through the gas discharge tube;

second means, comprising individual on/off semiconductor gating means in series with each fluorescent tube, for communicating a substantially constant current to the first electrode of each fluorescent tube during the period of illumination of that fluorescent tube;

third means for communicating a low voltage reference level to a second electrode of each fluorescent tube whereby the voltage drop across each tube is sufficient to maintain illumination in each fluorescent tube; and fourth means, comprising logic voltage level gating circuits receiving power from the well regulated logic voltage level power supply and electrically connected to each on/off semiconductor gating means, for selectively terminating conduction in each on/off semiconductor gating means thereby selectively extinguishing illumination in each fluorescent tube individually.

27. A system according to claim 26 wherein the second means further comprise means for maintaining the substantially constant current at essentially the same amperage for each fluorescent tube in the display array.

28. A system according to claim 26 wherein the second means comprise resistive connecting means providing interconnection between the fourth means and on/-off semiconductor gating means.

29. A system according to claim 28 wherein the semiconductor gating means comprise solid state transistor means with the base of the transistor means connected to the resistive connecting means and the emitter-collector junction providing a path for the substantially constant current.

30. A system for selectively controlling illumination in each fluorescent tube in a display array of fluorescent tubes, each fluorescent tube having at least two electrodes and ignition and illumination maintaining voltage levels which are greater than a maximum safe logic voltage level, said system comprising:

first means for communicating the gas discharge igniting voltage to a first electrode of each fluorescent tube;

second means, comprising individual on/off semiconductor gating means in series with each fluorescent tube, for communicating a substantially constant current to the first electrode of each fluorescent tube during the period of illumination of that fluorescent tube;

third means for communicating a low voltage reference level to a second electrode of each fluorescent tube whereby the voltage drop across each tube is sufficient to maintain illumination in each fluorescent tube;

fourth means, comprising logic voltage level gating circuits electrically connected to each on/off semiconductor gating means, for selectively terminating conduction in each on/off semiconductor gating means thereby selectively extinguishing illumination in each fluorescent tube individually;

the second means further comprising resistive connecting means providing interconnection between the fourth means and on/off semiconductor gating means; and the system further comprising means for isolating the second means of each fluorescent tube from the igniting voltage of the first means.

31. A method of selectively controlling illumination in each fluorescent tube in a display array of fluorescent tubes, each fluorescent tube having at least two electrodes, ignition and illumination maintaining voltage levels which are greater than a maximum safe logic voltage level, and ignition voltage levels which are substantially greater than illumination maintaining voltage levels, comprising the steps of:

providing a DC illumination maintaining voltage power supply comprising means for providing a substantially constant illumination maintaining voltage reference level and means for providing a low voltage reference level;

providing a well regulated logic voltage level power supply, and connecting the well regulated logic voltage level power supply to the constant DC illumination maintaining voltage power supply such that the current supply through the well regulated logic voltage level power supply is substantially independent of changes in electrical current flowing through the gas discharge tube;

communicating a gas discharge igniting voltage to a first electrode of each fluorescent tube;

connecting individual on/off semiconductor gating means in series with each fluorescent tube, whereby a substantially constant current from the DC illumination maintaining voltage power supply is communicated to the first electrode of each fluorescent tube during the period of illumination of that fluorescent tube;

providing logic voltage level circuits which are powered by the well regulated logic voltage level power supply and which are selectively connected to each individual on/off semiconductor gating means;

communicating a low voltage reference level to a second electrode of each fluorescent tube whereby the voltage drop across each tube is sufficient to maintain illumination in each fluorescent tube; and selectively terminating conduction in each on/off semiconductor gating means by a signal from each associated logic voltage level circuit thereby selectively extinguishing illumination in each fluorescent tube individually.

* * * * *